United States Patent [19]

Bach

[11] 4,329,741

[45] May 18, 1982

[54] GOLF GLOVE

[76] Inventor: Merlyn F. Bach, 203 W. Euclid, Des Moines, Iowa 50313

[21] Appl. No.: 155,547

[22] Filed: Jun. 2, 1980

Related U.S. Application Data

[63] Continuation-in-part of Ser. No. 47,169, Jun. 11, 1979, abandoned.

[51] Int. Cl.[3] ..... A41D 19/00

[52] U.S. Cl. ..... 2/161 A

[58] Field of Search ..... 2/161 A, 161 R, 159, 2/163, 165, 168

[56] References Cited

U.S. PATENT DOCUMENTS

| | | | |
|---|---|---|---|
| 2,258,999 | 10/1941 | Nunn | 2/161 A |
| 2,270,882 | 1/1942 | Link | 2/161 A |
| 2,302,875 | 11/1942 | Lykins | 2/161 A |
| 2,456,678 | 12/1948 | Cole | 2/161 A |
| 3,065,472 | 11/1962 | Linnell | 2/161 A |
| 4,000,903 | 1/1977 | Sanson | 2/161 A |

FOREIGN PATENT DOCUMENTS

| | | | |
|---|---|---|---|
| 2430092 | 1/1976 | Fed. Rep. of Germany | 2/161 A |

*Primary Examiner*—H. Hampton Hunter

*Attorney, Agent, or Firm*—Zarley, McKee, Thomte, Voorhees & Sease

[57] ABSTRACT

A golf glove having a palm portion, a wrist portion adjacent one end of the palm portion and a finger portion on an opposite end of the palm portion includes a first elongated pad secured to the palm portion and extended diagonally thereacross at a position adjacent to the finger portion and at an angle with respect to the finger portion. A second elongated pad is secured to the palm portion and extended diagonally thereacross in parallel spaced relationship to the first elongated pad so as to create a diagonally disposed valley portion between the first and second elongated pads to receive the handle of a golf club therein.

8 Claims, 4 Drawing Figures

GOLF GLOVE

This application is a continuation-in-part of application Ser. No. 47,169, filed June 11, 1979 and now abandoned.

BACKGROUND OF THE INVENTION

This invention relates generally to golf gloves and more particularly to an improved golf glove having a pair of elongated pads arranged in parallel spaced relationship diagonally across the palm portion of the glove adjacent the finger portion to create a valley portion therebetween for receiving the handle of a golf club.

Various attempts have been made in the past to modify the conventional golf glove to facilitate and improve a golfer's grip on the handle of a golf club shaft. All of the modified golf gloves of the prior art however, have certain shortcomings which are believed to be resolved by the golf glove of the present invention. For example, the glove of Swanson U.S. Pat. No. 4,000,903 provided a single relatively small ridge across the palm of a glove for abutment with a golf club shaft to align the shaft relative to the wearer's hand. Likewise, Nunn U. S. Pat. No. 2,258,999 shows a golf glove modified to include on the palm portion a single pad elongated in a direction away from the golf club shaft. Whereas both gloves tend to orient the handle relative to the wearer's hand, the single protrusion provided on each glove is believed to provide insufficient constraint to achieve uniform proper alignment. Furthermore, whereas the pad of the Nunn glove is of a thickness to effect the grip on the handle, its short length produces a void adjacent the pad whereby the grip is weakened at that point. All of the above shortcomings are believed to be overcome by the novel glove construction of the present invention.

Accordingly, it is a primary object of the invention to provide an improved golf glove.

A further object is to provide a golf glove which effects a proper orientation of the golf club handle with respect to the wearer's hand.

A related object is to provide a golf glove which gives the wearer's wrist its proper orientation with respect to the golf club.

A further object is to provide a golf glove having a pair of pads which coact to improve the wearer's grip on a golf club.

Another object is to provide a golf glove having a pair of spaced-apart elongated pads which create a valley portion between them for receiving the handle of a golf club.

Finally, it is an object to provide an improved golf glove which is comfortable in use and efficient in operation.

SUMMARY OF THE INVENTION

The golf glove of the present invention has a palm portion, a wrist portion adjacent one end of the palm portion and a finger portion on an opposite end of the palm portion. A first elongated pad is secured to the palm portion and extends diagonally across it at a position adjacent to and at an angle with respect to the finger portion. A second elongated pad is secured to the palm portion and extends diagonally across it in parallel spaced relationship to the first pad so as to create a diagonally disposed valley portion between the first and second pads to receive the handle of a golf club. The pads thus coact to provide a valley or pocket within which the club handle may be gripped. Both pads are extended substantially across the palm portion of the glove to provide elongated uniform contact surfaces which close on and grip the handle when the hand of the wearer of the glove closes in gripping relation on the handle. With the golf club handle received within the valley created by the spaced-apart pads, the golf club is properly oriented with respect to the wearer's hand. Furthermore, the wrist of the golfer's glove hand is automatically properly oriented with respect to the club. The pad adjacent the finger portion may be split to accommodate the space between fingers so as to provide the beneficial effects without compromising flexibility of the golfer's fingers.

DESCRIPTION OF THE PREFERRED EMBODIMENT

Figure 1:
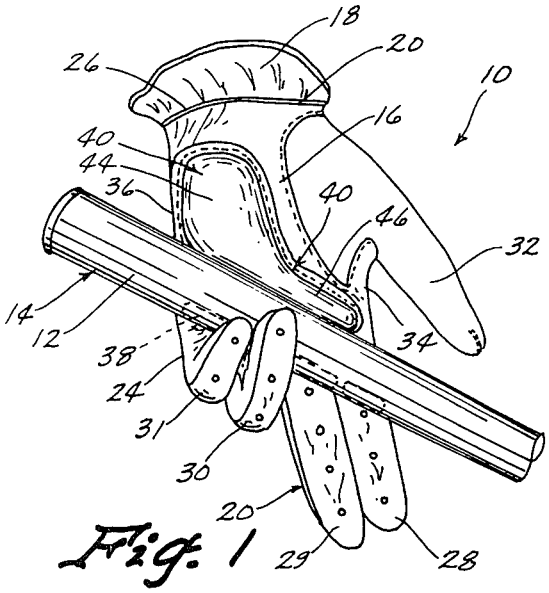
FIG. 1 is a perspective view of the golf glove of the present invention with a golf club handle received therein.
Figure 2:
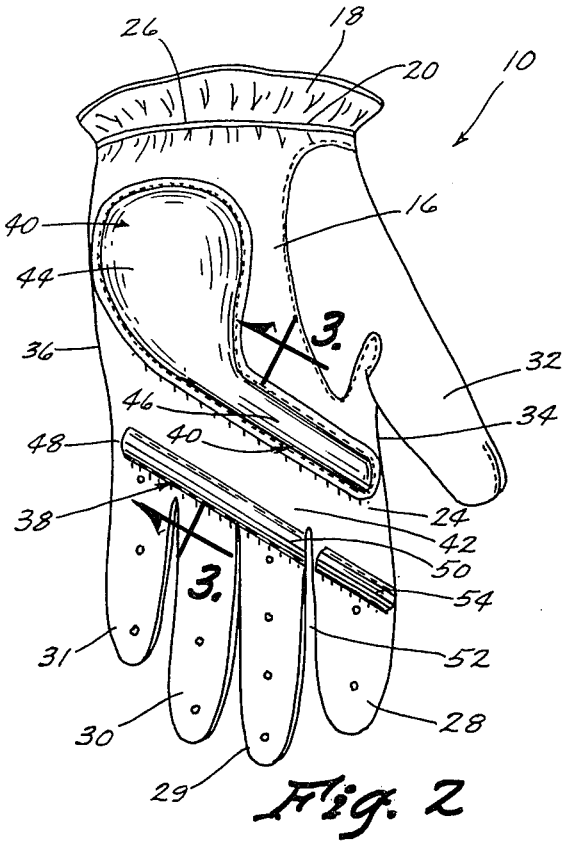
FIG. 2 is an enlarged plan view of the palm surface of the glove showing the first and second pads thereon.

The golf club 10 of the present invention is shown in FIG. 1 with the handle portion 12 of a golf club 14 received therein. Referring to FIG. 2, glove 10 includes a palm portion 16, a wrist portion 18 adjacent one end 20 of palm portion 16 and a finger portion, indicated generally at 22, on an opposite end 24 of palm portion 16. An elastic wrist band 26 is positioned at the juncture between the palm portion 16 and wrist portion 18. Finger portion 22 includes a plurality of separate finger members 28–31 to accommodate the four fingers of a wearer. Likewise, a thumb portion 32 is secured to what shall be referred to as the thumb side 34 of palm portion 16, with a heel portion being disposed adjacent the opposite side 36. The golf glove as thus far described is conventional.

In accordance with the present invention, a first elongated pad 38 is secured to the palm portion 16 and extends diagonally across it at a position adjacent to and at an angle with respect to the finger portion 22 as shown in FIGS. 1 and 2. In addition, a second elongated pad 40 is secured to the palm portion 16 and extends diagonally across it in parallel spaced relation to the first pad 38 to create a diagonally disposed valley portion 42 between the first and second pads to receive the handle 12 of a golf club between them.

In FIG. 2, it is seen that the second elongated pad 40 is somewhat club-shaped so as to include an enlarged head portion 44 which overlies the heel of palm portion 16, and an elongated shaft portion 46 which is positioned between the thumb portion 32 and first pad 38.

The first pad 38 is shown in FIG. 2 as extending from a rearward end 48 adjacent finger member 31 and opposite side 36 of palm portion 16 to a forward end 50 which extends onto finger member 29 and terminates at the edge of space 52 which separates finger members 28 and 29. A first pad extension 54 is secured to finger member 28 in linear alignment with first pad 38 so as to extend the first pad across space 52 without comprising any flexibility of finger member 28.

Figure 3:
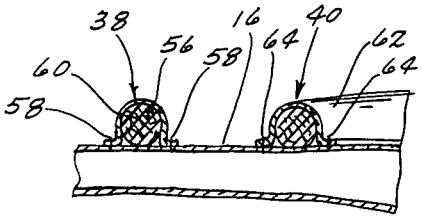
FIG. 3 is a transverse sectional view taken along line 3—3 in FIG. 2.

Referring to FIG. 3, it is seen that first pad 38 includes an inverted U-shaped pocket member 56 secured to palm portion 18 by suitable stitching along both edges as indicated at 58. A length of woven cord or rope 60 substantially fills pocket member 56. Cord 60 is preferably formed of dense, substantially non-compressible construction, while being freely flexible however. Second pad 40 likewise includes a second pocket member 62 secured to palm portion 16 by stitching as indicated at 64. Second pocket member 62, on the other hand, is substantially filled with a compressible material such as a dense foam padding.

Figure 4:
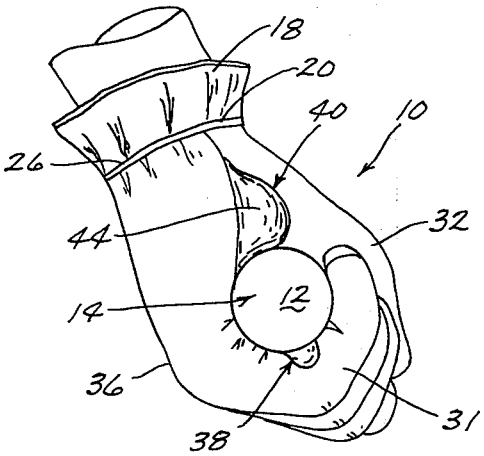
FIG. 4 is a perspective view showing the golf glove of the invention on a wearer's hand and in gripping relation on a golf club handle.

In operation, the golf glove 10 is adapted to be worn on the left hand of a right-handed golfer. It is to be understood that a similar glove could be made for the right hand of a left-handed golfer, that glove having the appearance of the mirror image of the glove shown in the drawings. Upon placement of the handle portion 12 of golf club into the valley portion 42 as shown in FIG. 1 with the golf club head lying flush with the ground, the golfer need only close his fingers onto the handle portion 12 to achieve a proper grip on the handle. The orientation of valley 42 with respect to palm portion 16 assures the proper orientation of the club relative to the golfer's left hand. Furthermore, it can be seen in FIG. 4 that when the golfer closes his fingers onto the handle, both the first and second pads 38 and 40 close on and grip the handle. Specifically, the first and second pads may be spaced apart sufficiently so as to be situated approximately 180° apart relative to the handle when the hand of the wearer of the glove closes in gripping relation on the handle. Second pad 40 strengthens the golfer's grip by providing additional contact surface with the golf club handle which would not be provided by a conventional glove. The fact that the pads are continuous substantially across the width of the wearer's palm further contributes to a uniform secure grip of the handle.

Accordingly, there has been shown and described an improved golf glove which accomplishes at least all of the stated objects.

I claim:

1. A golf glove comprising a palm portion, a wrist portion adjacent one end of the palm portion and a finger portion on an opposite end of said palm portion comprising, a first elongated pad secured to said palm portion and extending diagonally thereacross adjacent to and at an angle with respect to said finger portion, and a second elongated pad secured to said palm portion and extending diagonally thereacross in parallel spaced relation to said first elongated pad, said first and second elongated pads protruding from said palm portion to create a diagonally disposed valley portion therebetween to receive the handle of a golf club in substantially parallel orientation to said first and second pads.

2. The golf glove of claim 1 wherein said first and second elongated pads serve to close on and grip said handle when the handle of the wearer of the glove closes in gripping relation on said handle.

3. The golf glove of claim 1 further comprising a thumb portion on one side of said palm portion and a heel portion on the opposite side of said palm portion, said second elongated pad including an enlarged head portion overlying said heel portion and an elongated shaft portion disposed between said thumb portion and first pad.

4. The golf glove of claim 1 wherein said second pad has a larger cross sectional area than said first pad.

5. The golf glove of claim 1 wherein said first pad includes an elongated first pocket and a generally non-compressible cord positioned therein to substantially fill said first pocket.

6. The golf glove of claim 5 wherein said second pad includes an elongated second pocket and a substantially compressible material therein to substantially fill said second pocket.

7. The golf glove of claim 1 wherein said first and second pads are spaced apart sufficiently to be situated approximately 180° apart relative to said handle when the hand of the wearer of the glove closes in gripping relation on said handle.

8. The golf glove of claim 1 wherein said finger portion includes separate finger members having spaces therebetween, and further comprising a first pad extension secured to a finger member and positioned in linear alignment with said first pad.

* * * * *